US011225821B2

(12) United States Patent
Trobro et al.

(10) Patent No.: US 11,225,821 B2
(45) Date of Patent: Jan. 18, 2022

(54) DOOR OPERATOR

(71) Applicant: ASSA ABLOY ENTRANCE SYSTEMS AB, Landskrona (SE)

(72) Inventors: Christian Trobro, Lerberget (SE); Mathias Navne, Svalov (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 0 days.

(21) Appl. No.: 16/626,093

(22) PCT Filed: Jun. 21, 2018

(86) PCT No.: PCT/EP2018/066513
§ 371 (c)(1),
(2) Date: Dec. 23, 2019

(87) PCT Pub. No.: WO2019/002063
PCT Pub. Date: Jan. 3, 2019

(65) Prior Publication Data

US 2020/0208459 A1 Jul. 2, 2020

(30) Foreign Application Priority Data

Jun. 30, 2017 (SE) ..... 1730179-7

(51) Int. Cl.
*G07C 9/00* (2020.01)
*E05F 15/668* (2015.01)
(Continued)

(52) U.S. Cl.
CPC ..... *E05F 15/668* (2015.01); *E05F 15/40* (2015.01); *E05F 15/70* (2015.01);
(Continued)

(58) Field of Classification Search
CPC ..... E05F 15/73; E05F 2015/765; E05F 2015/767; E05F 15/60; E05F 15/40;
(Continued)

(56) References Cited

U.S. PATENT DOCUMENTS 4,847,542 A * 7/1989 Clark ..... G07C 9/00182 318/560
8,633,799 B1 * 1/2014 Aronson ..... G07C 9/00896 340/5.73
(Continued)

FOREIGN PATENT DOCUMENTS

DE 19901487 7/2000
DE 102015005639 11/2016
(Continued)

OTHER PUBLICATIONS

Swedish Search Report mailed in SE 1730179-7 dated Mar. 6, 2018.
International Search Report mailed in PCT/EP2018/066513 dated Sep. 27, 2018.

*Primary Examiner* — Dionne Pendleton
(74) *Attorney, Agent, or Firm* — Wissing Miller LLP

(57) ABSTRACT

The present invention relates to a door operator (1) and to a method performed in a door operator system (100) comprising a door operator (1) connected to and arranged to move at least one door leaf (5) between an open and closed position, the door operator (1) comprising a control unit (3) configured to control the movement of the at least one door leaf (5), the method comprising: obtaining (S100), in a sleep mode of the door operator system (100), a sequence of input data in one or more components of the door operator (1) or the at least one door leaf (5), receiving (S110), in the control unit (3) of the door operator (1), said sequence of input data from the one or more components, and evaluating (S120) said sequence of input data and ranking (S130) the prob-
(Continued)

ability of that said sequence of input data corresponds to an intrusion attempt on the door operator system (100).

25 Claims, 4 Drawing Sheets

(51) Int. Cl.
*E05F 15/40* (2015.01)
*E05F 15/70* (2015.01)

(52) U.S. Cl.
CPC ..... *E05Y 2400/822* (2013.01); *E05Y 2800/00* (2013.01); *E05Y 2900/106* (2013.01); *E05Y 2900/132* (2013.01)

(58) Field of Classification Search
CPC . E05F 15/79; E05F 15/43; E05F 15/77; E05F 15/00; E05F 15/70; E05F 15/74; E05F 3/22; E05F 15/42; E05F 15/608; E05F 15/627; E05F 15/63; E05F 15/646; E05F 17/002; E05F 2017/008; E05F 15/41; E05F 15/632; E05F 15/76; E05F 2015/437; E05F 2015/483; E05F 2015/631; E05F 3/102; E05F 15/603; E05F 2015/432; E05F 2015/434; E05F 2015/763; E05F 15/668; G07C 9/00309; G07C 2209/63; G07C 2009/00769; G07C 9/00896; G07C 9/15; G07C 9/00; G07C 9/30; G07C 2209/64; G07C 9/10; G07C 9/28; G07C 1/02; G07C 1/10; G07C 2009/00341; G07C 2009/00507; G07C 2009/00793; G07C 2009/00984; G07C 2209/08; G07C 9/00904; G07C 9/20; G07C 9/253; G07C 9/29; G07C 9/37; G07C 2009/00388; G07C 2209/62; G07C 2209/65; G07C 9/00174; G07C 9/00571; G07C 9/27; G07C 9/38; E05Y 2900/132; E05Y 2900/546; E05Y 2400/44; E05Y 2400/82; E05Y 2400/858; E05Y 2400/852; E05Y 2400/53; E05Y 2201/21; E05Y 2201/462; E05Y 2400/302; E05Y 2400/32; E05Y 2400/322; E05Y 2400/40; E05Y 2400/45; E05Y 2400/532; E05Y 2400/822; E05Y 2400/86; E05Y 2800/40; E05Y 2900/00; E05Y 2900/106; E05Y 2900/516; E05Y 2900/532; E05Y 2201/234; E05Y 2400/30; E05Y 2400/36; E05Y 2400/54; E05Y 2400/66; E05Y 2400/85; E05Y 2400/856; E05Y 2600/454; E05Y 2800/10; E05Y 2800/106; E05Y 2800/11; E05Y 2800/113; E05Y 2800/21; E05Y 2800/22; E05Y 2800/426; E05Y 2900/10; E05Y 2900/104; E05Y 2900/112; E05Y 2900/50; E05Y 2900/506; E05Y 2900/51; E05Y 2900/531; E05Y 2400/452; E05Y 2400/814; E05Y 2800/00; E05Y 2800/424; G05B 15/02; G05B 2219/163; G05B 2219/2642; G05B 17/02; G05B 2219/40062; B60R 25/2054; B60R 25/24; B60R 25/245; B60R 1/1207; B60R 2001/1253; B60R 2325/20; B60R 25/20; B60R 3/00; B60R 19/48; B60R 25/10; B60R 25/246; B60R 5/044; B66B 13/26; B66B 13/146; B66B 1/2408; B66B 1/3476; B66B 1/468; B66B 2201/215; B66B 2201/222; B66B 5/0012; E05B 81/78; E05B 47/00; E05B 81/76; E05B 83/16; E05G 5/02; E05G 5/003; E05G 1/026; G01V 8/20; G01V 3/08; G01V 8/12; G01V 8/10; G07F 19/201; G07F 19/205; G07F 19/203; G07F 19/206; H04N 7/186; H04N 7/183; H04N 7/147; H04N 7/181; H04N 5/23206; H04N 7/142; H04N 7/188; H04N 7/14; H04N 7/141; H04N 7/157; H04N 7/18; B60Q 1/24; B60Q 2400/40; B60Q 1/32; B60Q 2900/30; B60Q 5/005; B60Q 5/006; E06B 2009/6836; E06B 11/085; E06B 9/68; E06B 9/88; E06B 2009/587; E06B 2009/6827; E06B 2009/6845; E06B 2009/801; E06B 2009/885; E06B 5/10; E06B 5/106; E06B 9/11; E06B 9/13; E06B 9/58; E06B 9/82; G06K 9/00771; G06K 9/00288; G06K 9/00778; G06K 9/00791; G06K 2009/00939; G06K 2009/3291; G06K 7/10297; G06K 9/0002; G06K 9/00107; G06K 9/0012; G06K 9/00369; G06K 9/00711; G06K 9/00906; G06K 9/228; G06K 9/32; G06Q 40/08; G06Q 20/1085; G06Q 10/20; G06Q 30/01; G06Q 30/018; G06Q 30/0241; G06Q 30/0278; G06Q 50/16; G06Q 50/163; G06Q 10/02; G06Q 10/087; G06Q 20/20; G06Q 20/32; G06Q 20/322; G06Q 20/3223; G06Q 20/3278; G06Q 20/40145; G08B 21/043; G08B 13/19608; G08B 13/19697; G08B 13/22; G08B 17/10; G08B 21/02; G08B 21/0446; G08B 21/0461; G08B 21/182; G08B 7/062; G08B 7/066; G08B 13/196; G08B 13/19604; G08B 13/19613; G08B 13/19615; G08B 13/19645; G08B 13/19652; G08B 13/19656; G08B 13/19663; G08B 21/0202; G08B 21/0476; G08B 29/188; G08B 31/00; H03K 17/955; H03K 2017/9602; H03K 2217/960705; H03K 2217/960755; H03K 2217/96078; H04W 12/0013; H04W 12/02; H04W 4/02; H04W 4/024; H04W 4/90; H04W 12/00508; H04W 12/06; H04W 4/023; H04W 4/40; H04W 4/80; H04W 64/006; A47C 19/045; A47F 7/00; A61B 17/52; A61B 2503/04; A61B 2562/0247; A61B 2562/0257; A61B 2562/029; A61B 5/0022; A61B 5/02416; A61B 5/02438; A61B 5/0261; A61B 5/0488; A61B 5/0816; A61B 5/11; A61B 5/1115; A61B 5/1117; A61B 5/1172; A61B 5/145; A61B 5/14532; A61B 5/14551; A61B 5/14552; A61B 5/4011; A61B 5/447; A61B 5/4845; A61B 5/489; A61B 5/6808; A61B 5/742; A61B 5/7455; A61B 5/746; A61F 13/00055; A61F 13/42; A61F 2013/424; A61G 2203/34; A61G 2203/72; A61G 2203/726; A61G 2203/74; A61G 7/00; A61G 7/005; A61G 7/008; A61G 7/012; A61G 7/015; A61G 7/018; A61G 7/05; A61G 7/0507; A61G 7/0513; A61G 7/0527; A61G 7/057; A61G 7/05715; A61G 7/05769;

A61H 2201/1207; A61H 2201/165; A61H 2201/1654; A61H 2201/5043; A61H 2201/5058; A61H 23/00; A61H 23/02; A61M 2230/201; A61M 35/10; A61M 37/0084; A61M 5/1723; B05B 12/122; B05B 1/16; B25J 19/0025; B60B 33/0005; B60B 33/0039; B60B 33/0049; B60B 33/0057; B60B 33/0068; B60B 33/0073; B60B 33/021; B65G 1/02; E04H 9/04; E04H 9/06; F16P 3/14; F41H 5/24; G01D 5/24; G01R 31/66; G06M 11/00; G06M 1/10; G06T 2207/10016; G06T 2207/30196; G06T 7/20; G06T 7/593; G06T 7/70; G07G 1/0018; G08G 1/015; G08G 1/04; G08G 1/042; G08G 1/056; G16B 25/00; G16B 30/00; H01H 3/142; H01H 3/16; H01Q 15/0073; H01Q 1/3233; H01Q 21/065; H01Q 3/34; H01Q 3/36; H01Q 3/46; H02G 11/00; H02G 11/02; H02G 3/32; H04B 5/0031; H04B 5/0062; H04M 1/03; E05D 15/58; E05D 15/0604; G01B 7/023; G01B 7/003; G01B 7/14; G01B 11/14; G01S 17/89; G01S 13/931; G01S 17/58; G01S 2013/93272; G01S 2013/93275; G01S 13/0209; G01S 13/04; G01S 13/08; G01S 13/867; G01S 13/88; G01S 13/887; G01S 13/89; G01S 17/10; G01S 17/86; G01S 17/87; G01S 2013/0245; G01S 2013/0254; G01S 2013/93273; G01S 2013/93277; G01S 7/41; G01S 7/415; G01S 7/4802; G01S 7/497; G06F 21/84; G06F 3/0488; G06F 16/7837; G06F 16/7847; G06F 16/7854; G06F 16/786; G06F 2203/04103; G06F 3/00; G06F 3/0436; G06F 21/32; G06F 21/316; G06F 21/552; G06F 2221/2117; A47G 5/00; A61L 2202/17; A61L 2202/23; B08B 13/00; B08B 3/02; B60J 5/0497; B60J 5/062; B60J 5/101; B60J 5/00; B60J 5/10; B60K 2370/178; B60K 2370/193; B60K 2370/21; B60K 2370/334; B60K 2370/56; B60K 2370/589; B60K 2370/741; B60K 2370/777; B60K 2370/797; B60K 35/00; B60K 6/20; B60K 6/26; B60K 6/28; B60L 58/26; B60N 2/005; B60N 3/001; B60N 3/008; B60N 3/10; B60N 3/16; B60N 2/0224; B60N 2/0228; B60N 2/065; B60N 2/20; B60N 2/3011; B60N 2/757; B62D 33/0612; E04B 1/8218; E04B 2002/7479; E04B 2002/7483; E04B 2/7403; E04B 2/7405; F21W 2102/40; G01C 21/20; G01C 22/006; G01J 1/0238; G01J 1/0295; G01J 1/0411; G07B 15/04; G10K 11/20; G10K 11/28; H04L 12/2803; H04L 12/2818; H04L 12/2825; H04L 12/283; H04L 67/12; H04L 63/0492; H04L 63/083; H04L 63/0861; H04Q 2209/60; H04Q 2209/823; H04Q 9/02; H04R 1/323; H04R 2201/021; H04R 5/02; Y02T 10/70; Y10S 903/906; Y10S 903/907; A47B 53/02

See application file for complete search history.

(56) References Cited

U.S. PATENT DOCUMENTS

| | | | | |
|---|---|---|---|---|
| 2005/0033962 | A1* | 2/2005 | Libin | G07C 9/27 713/170 |
| 2008/0165001 | A1 | 7/2008 | Drake | |
| 2009/0212943 | A1 | 8/2009 | Burnard | |
| 2016/0040469 | A1* | 2/2016 | Lietz | E05F 15/77 49/13 |
| 2016/0117918 | A1 | 4/2016 | Schindler | |
| 2016/0189531 | A1 | 6/2016 | Modi et al. | |

FOREIGN PATENT DOCUMENTS

| | | |
|---|---|---|
| GB | 2231696 | 11/1990 |
| WO | 2007120140 | 10/2007 |

* cited by examiner

DOOR OPERATOR

This application is a 371 of PCT/EP2018/066513 filed on Jun. 21, 2018, published on Jan. 3, 2019 under publication number WO 2019/002063, which claims priority benefits from Swedish Patent Application No. 1730179-7 filed on Jun. 30, 2017, the disclosure of which is incorporated herein by reference.

FIELD OF THE INVENTION

The present invention relates to a method performed in a door operator system and to a door operator.

BACKGROUND OF THE INVENTION

A door operator system typically comprises a door operator connected to at least one door leaf.

The door operator systems are often located in a store, a factory or in an office building, which are unattended after the opening hours of the store or after working hours. The door operator systems are thus exposed to burglars and persons trying to intrude the area enclosed by the door operator system. To reduce the risk of an intrusion, the door operator system could be connected to a burglar alarm that is activated when a burglar forces the door operator system. In some cases, the burglar alarm is connected to a guard that is alerted by the alarm. An intrusion is very costly, both in damages of the door operator system and the premises in addition to the stolen goods.

SUMMARY OF THE INVENTION

An object of the present disclosure is to provide a door operator and a method which seek to mitigate, alleviate, or eliminate one or more of the above-identified deficiencies in the art and disadvantages singly or in any combination.

An object of the present disclosure is to provide a door operator and a method that is able to detect an intrusion attempt before the door operator system is forced or even damaged.

An object of the present invention is to provide a door operator system which could reduce the response time of a guard.

An object of the present invention is to provide a door operator which opens up for that measures could be taken before the door operator is damaged by an intrusion attempt.

An object of the present invention is to provide a door operator system which opens up for that measures could be taken to interrupt an intrusion attempt.

In this disclosure, a solution to the problem outlined above is proposed.

According to a first aspect of the present invention, these objects are achieved by a method in a door operator system comprising a door operator connected to and arranged to move at least one door leaf between an open and closed position, the door operator comprising a control unit configured to control the movement of the at least one door leaf, the method comprising: obtaining, in a sleep mode of the door operator system, a sequence of input data in one or more components of the door operator or the at least one door leaf, receiving, in the control unit of the door operator, said sequence of input data from the one or more components, and evaluating said sequence of input data and ranking the probability of that said sequence of input data corresponds to an intrusion attempt on the door operator system.

By using the method according to the above an intrusion attempt could be identified early and measures based on the ranking of the probability could be taken. High costs due to damage on the door operator system made by an intrusion could be avoided. By using the method, the consequence of the action taken could be aligned with the level of probability of the ranking. Lightening up the entrance could for instance be done on a first level, but calling for security could be done after a very high ranking of probability.

According to an aspect the step of evaluating is performed in said control unit.

According to an aspect the step of evaluating is performed in a remote entity.

According to an aspect the ranking of the probability is categorized into at least a low or a high probability category.

According to an aspect the ranking of the probability is categorized into at least three different probability categories.

According to an aspect the method further comprise the step of triggering an alarm related to said probability when said probability is ranked.

According to an aspect the step of triggering comprise the step of activating an alarm component of the door operator system.

According to an aspect the alarm component is one or more of a lamp and a speaker.

According to an aspect the step of triggering comprise the step of sending an alarm signal to at least one remote entity.

According to an aspect the step of sending an alarm signal to at least one remote entity is made via a radio communication interface of the door operator configured to communicate with the at least one remote entity.

According to an aspect said components is one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf.

According to an aspect the step of ranking the probability of that said sequence of input data comprise the step of determining if said sequence of input data corresponds to one or more of a number of predefined sequences of input data According to a second aspect of the present invention, these objects are achieved by a door operator comprising a control unit and a drive unit connected to the control unit, wherein the drive unit is arranged to be connected to and to move at least one door leaf between an open and closed position, the control unit is arranged to control the drive unit, the door operator is configured to be arranged in a sleep mode and in an activated mode, and the door operator is configured to, in the sleep mode of the door operator, receiving, in the control unit, a sequence of input data from one or more components of the door operator and/or the door leaf, and evaluating said sequence of input data and ranking the probability of that said sequence of input data corresponds to an intrusion attempt on the door operator.

According to an aspect the control unit is configured to perform said evaluating.

According to an aspect the door operator comprise a radio communication interface configured to communicate with the at least one remote entity and to send said sequence of input data to said at least one remote entity.

According to an aspect the door operator is configured to rank the probability into at least a low or a high probability category.

According to an aspect the door operator is configured to rank the probability into at least three different probability categories.

According to an aspect the door operator is configured to trigger an alarm related to a probability when said probability is ranked.

According to an aspect the door operator further comprise an alarm component configured to activate an alarm.

According to an aspect the alarm component is one or more of a lamp and a speaker.

The door operator is according to an aspect configured to send an alarm signal to at least one remote entity via the radio communication interface.

According to an aspect the components is one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf.

According to an aspect the door operator is configured to determine if said sequence of input data corresponds to one or more of a number of predefined sequences of input data.

According to an aspect the control unit comprise a central processing unit (CPU) and a data storage configured to store said sequences of input data.

According to an aspect the door operator is a revolving door operator, a swing door operator, a hinged door operator, an up and over door operator, a roll door operator, a garage door operator, an industrial door operator, a high speed door operator, a sectional door operator, a gate operator, a barrier operator, an or any device having the same function as a door operator.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

The foregoing will be apparent from the following more particular description of the example embodiments, as illustrated in the accompanying drawings in which like reference characters refer to the same parts throughout the different views. The drawings are not necessarily to scale, emphasis instead being placed upon illustrating the example embodiments.

DETAILED DESCRIPTION

Aspects of the present disclosure will be described more fully hereinafter with reference to the accompanying figures. The assembly disclosed herein can, however, be realized in many different forms and should not be construed as being limited to the aspects set forth herein.

The terminology used herein is for the purpose of describing particular aspects of the disclosure only, and is not intended to limit the disclosure. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The present invention relates to door operator systems for different types of doors, door sets and door leafs. More specifically, the invention relates to door operator systems for any type of door, a sectional door, a high speed door, a gate or barrier obstructing passage, such as a revolving door, a swing door, a hinged door, an up and over door, a roll door, a garage door, an industrial door, a gate, a barrier, an or any device having the same function as a door.

According to an aspect, a door operator system comprises one or more door operators connected to one or more door leafs.

Figure 1:
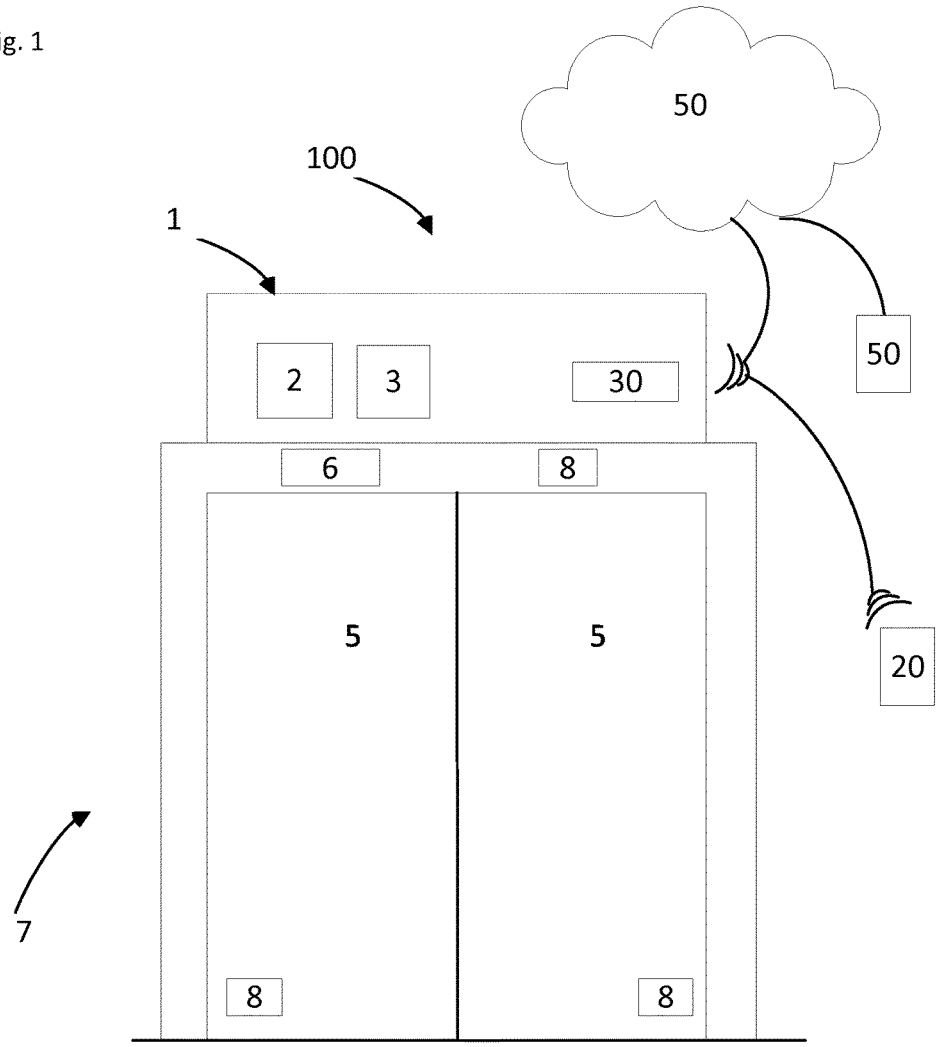
FIG. 1 discloses a schematic view of a door operator system according to an aspect of the invention comprising a sliding door operator.
Figure 2:
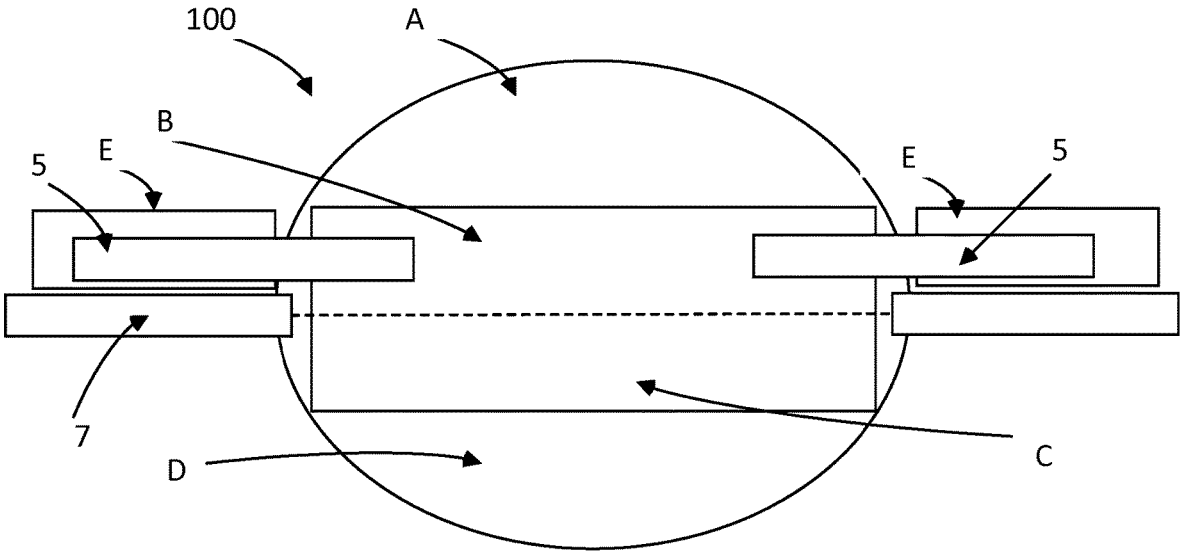
FIG. 2 disclose a cross sectional view of the door operator system in FIG. 1.
Figure 3:
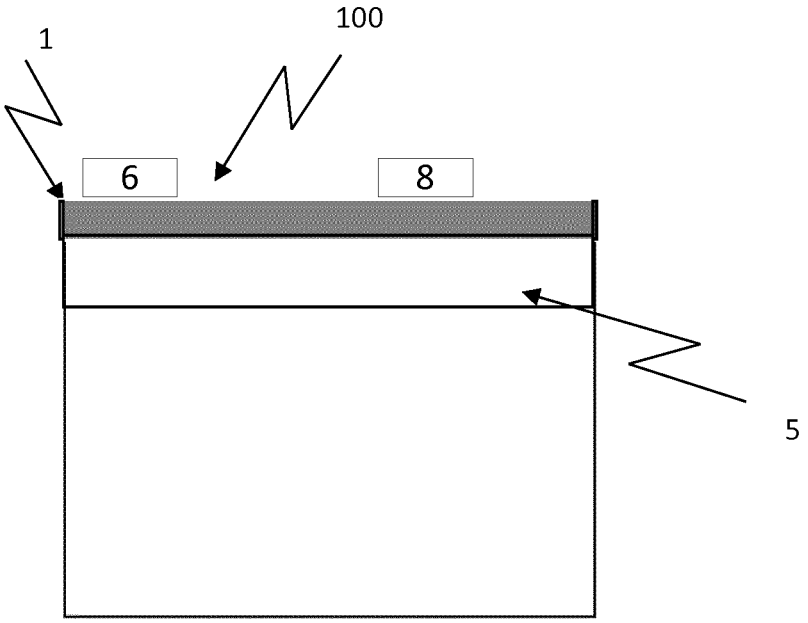
FIG. 3 discloses a schematic view of a door operator system according to an aspect of the invention comprising a high speed door operator.
Figure 4:
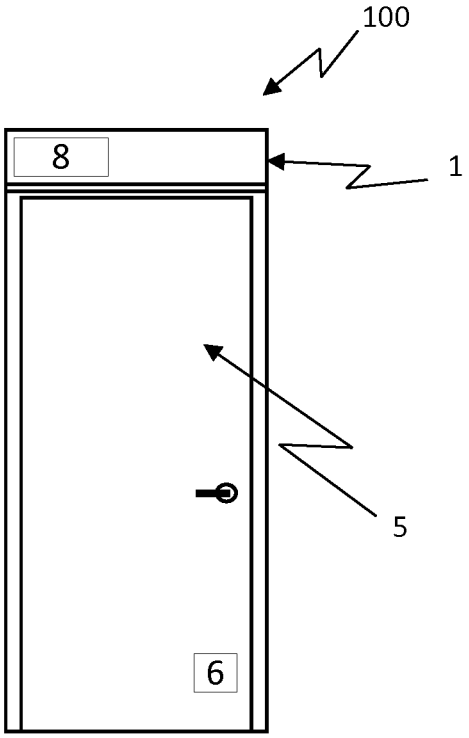
FIG. 4 discloses a schematic view of a door operator system according to an aspect of the invention comprising a swing door operator.
Figure 5:
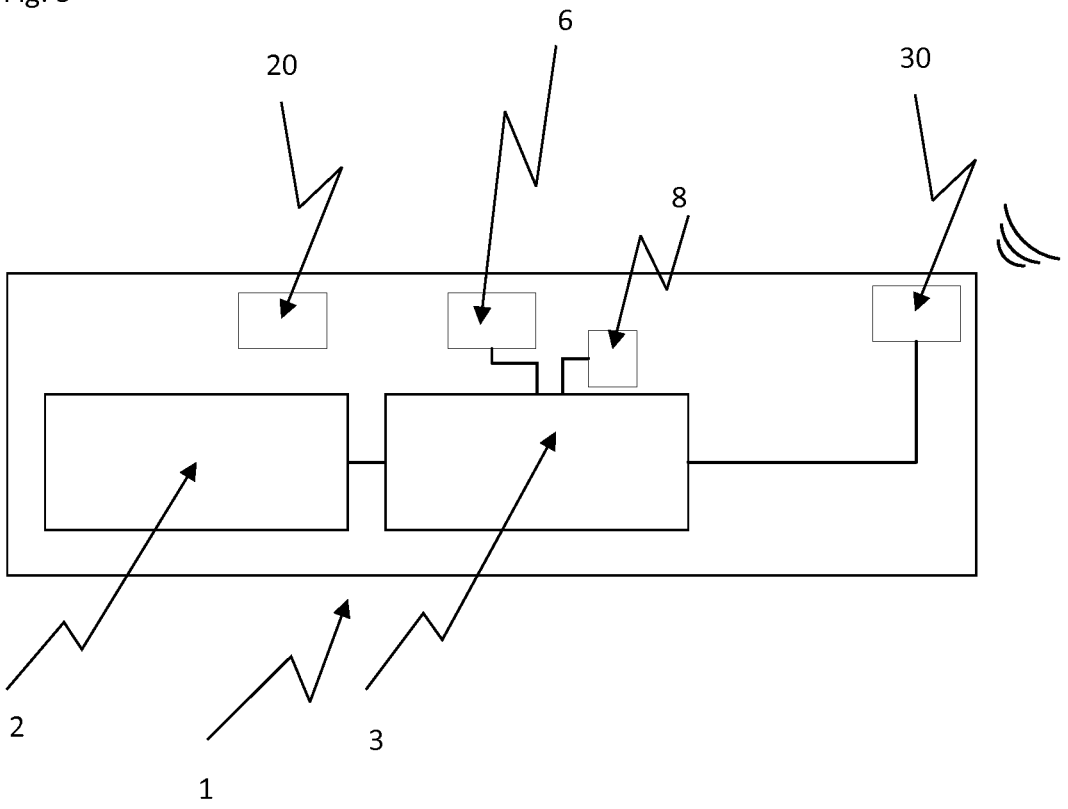
FIG. 5 discloses a schematic view of a door operator according to an aspect of the invention.

A door operator system 100 is disclosed in FIGS. 1 and 2 comprising a sliding door operator 1 connected to two door leafs 5. The door operator system 100 disclosed in FIG. 3 comprise a high speed door operator 1 connected to a door leaf 5. The door operator system 100 disclosed in FIG. 4 comprise a swing door operator 1 connected to a door leaf 5.

In FIGS. 1 to 5, to which now is referred, discloses the door operator 1 comprising a drive unit 2 and a control unit 3. The door operator 1 further comprises one or more of a battery (not disclosed), a belt transmission (not disclosed), a carriage wheel (not disclosed), an arm systems (not disclosed) and presence sensors (not disclosed). These components as such are known in the art and will not be described in detail herein. The door operator can also comprise further components.

The drive unit 2 is connected to the control unit 3. The drive unit 2 comprise a motor and a gearbox. The drive unit 2 is adapted to be connected to a door/door leaf/door set 5 and to move the door leaf 5 between an open and closed position, i.e. from an open position to a closed position and from a closed position to an open position. The drive unit 2 as such, its connection to the door leaf 2 and its connection to and interaction with the control unit 3 is known in the art and will thus not be described in more detail herein.

The control unit 3 is connected to the drive unit 2. The connection between the control unit 3, drive unit 2 and the components of the door operator 1 and/or the door leaf 5 is an electronically or a mechanically connection. According to some aspects the control unit 3 is connected to the drive unit 2 and one or more of the components via a wireless connection suitable for sending electronic signals. The connection may also be a combination of wired and wireless connection. Examples of wireless connections are Bluetooth™, WiFi, Infrared or any kind of near field communication technology. According to some aspects the control unit 3 is directly connected to the drive unit 2 and the components. Directly connected means that the control unit 3 is in direct communication with the drive unit 2 and the components. Direct communication may occur both via a wired connection or a wireless connection or a combination of both. In the case of wireless connection there will be a transceiver for the wireless signal on both the control unit 3 side, the drive unit 2 side and component side. Data can be sent to and from the components to the control unit 3 and/or to the drive unit 2. According to an aspect the control unit 3 comprise a central processor unit (CPU) (not disclosed) and a memory (not disclosed). The control unit 3 controls the movement of the drive unit 2.

The control unit 3 controls when the drive unit 2 should move the door leaf 5 between the open and closed position and how it should move it. The trajectory that the control unit 3 controls the drive unit 2 to move the door leaf 5 along comprise information of which speed the door leaf 5 should be moved, acceleration, braking, the opening time, for how long the door should be open and/or the closing speed etc. The control unit 3 can store different trajectories and control the drive unit 2 to move the door leaf 5 along different trajectories. The control unit 3 is connected to one or more presence sensors 8 and/or activation sensors 6 arranged to detect objects and persons approaching the door operator 1 and to send data to the control unit 3 if a person is detected.

The activation sensor 6 and the presence sensor 8 are adapter to monitor an area A, B, C, D, E and provide sensor data of that a person or an object are detected in the monitored area as it enters or are located in the monitored area A, B, C, D, E. By providing sensor data is meant that the sensor 6, 8 provide/create/measure/obtains/observe an area and create data of it that could be transferred.

The activation sensors 6 monitor an activation area A, D at the door leaf 5. The first activation sensors 6 monitor a first activation area A at an outer side of the door leaf 5. The second activation sensor 6 monitor a second activation area D at an inner side of the door leaf 5. When an object or person enters into the first or second activation area A, D the activation sensors 6 detects the person or objects and obtains activation data. The activation sensors 6 send the activation data to the control unit 3 associated with that an object is detected in the first and/or second activation area A, D. The first and second activation sensors 6 also send the activation data to the supervise unit 4 associated with that an object is detected in the first and/or second activation area A, D. The first and second activation sensor 6 could be a radar sensor. The activation area A on the outer or inner side of the door is an area that a person or objects that intends to pass through the door enters before it comes to the door.

The presence sensor 8 monitors a risk area at the door leaf 5. When an object or person enters into the risk area B, C, E the presence sensor 8 detects the person or objects and obtains presence data. The presence sensor 8 send presence data associated with that an object is identified in the risk area B, C to the control unit 3. The presence sensor 8 send presence data associated with that an object is detected in the risk area B, C to the supervise unit 4.

The activation sensors 6 and presence sensors 8 as such are known in the art and will thus not be described in more detail herein.

The door operator 1 and the door leafs 5 are connected to a door frame 7.

The control unit 3 is arranged to control the drive unit 2 to move the door leaf 5 at least based on input from the activation sensors 6 and presence sensor 8, as is disclosed in FIGS. 1 and 2. When a person or an object such as a car or a truck is approaching the door operation system 100 it first approaches an activation area A, D either on the inner or outer side of the door leaf 5. As it enters the activation area A, D that the activation sensor 6 monitors, the activation sensor 6 detects it and sends activation data to the control unit 3. The control unit 3 receives the activation data and controls the drive unit 2 to start to open the door leaf 5. After a predetermined time from having received the activation data the control unit 3 control the drive unit 2 to close the door leaf 5. If however the one of the activation sensors 6 detects that a person or an object is present in the activation area A, D it will send activation data thereof to the control unit 3. The control unit 3 will receive the activation data and interrupt the closing of the door leaf 5 and instead control the drive unit 2 to open the door leaf 5 again. This could be due to that the person have stopped and stands still in an activation area A, D or that a further person or object has entered into the activation area A, D.

The presence sensors 8 monitors risk areas B, C, E at the door operator system 100. A risk area B, C, E is an area where a moving door leaf 5 or any other moving part or the door operator system 100 could risk colliding and injuring a person or an object or the door operator system 100. When a presence sensor 8 monitors a risk area B, C, E and detects a person or an object in the risk area B, C, E it will send presence data to the control unit 3. The control unit 3 receives the presence data and will control the drive unit 2 based on the received presence data. It could be to interrupt the opening of the door leaf 5 if an object is detected in the path of the opening door leaf 5. It could also be to interrupt the closing of the door leaf 5 and open the door leaf 5 again if a person or object is detected in the door opening.

The control unit 3 as such is known in the art and is not described in more detail herein.

The door operator 1 further comprise one or more of a battery, a belt (not disclosed), transmissions (not disclosed), an arm system (not disclosed), one or more carriage wheels (not disclosed) and one or more sensors 8.

According to one aspect, the door leaf 5 is connected to one or more of the arm systems, floor guides and carriage wheels.

The door operator 1 as such can comprise further features and components that are known in the art, and will thus not be further described herein.

The door leaf 5 as such can comprise further features and component that is known in the art, and will thus not be further described herein.

According to an aspect, the door operator 1 further comprise a radio communication interface 30 connected to the control unit 3 and configured to communicate with at least one remote entity 50. The radio communication interface 30 may be comprised as any number of tranceiving, receiving, and/or transmitting units or circuitry. It should further be appreciated that the radio communication interface 30 may be in the form of any input/output communications port known in the art. The radio communication interface 30 may comprise RF circuitry and baseband processing circuitry. The radio communication interface 30 may support either wireless and/or wired communication. Examples of wireless communication may be Global System for Mobile Communication, GSM, Bluetooth, narrowband communication, Internet of Things, IoT, specific communication.

According to an aspect, the door operator 1 comprises a user interface unit 20. The user interface unit 20 is connected to the control unit 3. The user interface unit 20 is configured to display an alarm based on the ranking. According to an aspect, the user interface unit 20 is a display and/or one or more lamps and a loudspeaker.

According to an aspect, the one or more remote entity 50 is a server, a database, a further door operator and/or the cloud.

The control unit 3 is configured to receive an input data from the one or more components of the door operator 1 and/or the door leafs 5. The door operator system 100 is set in an active mode when it should detect persons and let persons pass through the door operator system 100. An active mode could be when the door is unlocked or when the door operator system 100 is turned on.

When a shop closes or an office building is closed for the day, the door operator system 100 is put in a sleep mode. In other words the door operator system 100 is put in an idle mode or an off mode. In the sleep mode the door operator system 100 should not let any persons pass through the door until it is activated and put in an active mode.

The active mode as such is well known and will not be described more herein.

The door operator system 100 and its door operator 1 and the control unit 3 and components are not entirely shut down in the sleep mode and the control unit 3 is configured to receive input data from the components of the door operator system 100 in the sleep mode. The door operator 1 obtains, in the sleep mode of the door operator system 100, a sequence of input data in one or more components of the door operator 1 or the door leaf 5. The sequence of input data could according to an aspect come from one or more components of the door operator system 100. According to an aspect, the input data is one or more of input data from an activation sensors 6 sensing something, presence sensors 8 on the outside of the door leaf 5 sensing something, door mounted sensors on revolving doors are activated, indications of door leaf movements via the encoder on the motor shaft, sounds from a sound sensor, light sensor, the lock being unlocked, the safety edge on the sectional doors are activated and deactivated sequentially, movement indicated in the drive unit.

A sequence of input data is at least two or more input data from one or more components. The control unit is configured to receive the sequence of input data from the one or more components. According to an aspect the components are one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf. The input data is data from one or more of the components.

The sequence of input data is evaluated. According to an aspect the control unit 3 is configured to evaluate the sequence of input data. According to an aspect the sequence of input data is sent to the at least one remote entity 50 via the radio communication interface 30. According to an aspect the sequence of input data is evaluated by the at least one remote entity 50.

The evaluation is ranking the probability of that said sequence of input data corresponds to an intrusion attempt on the door operator system. According to an aspect the control unit 3 is configured to rank the probability. According to an aspect the ranking is performed by the at least one remote entity 50. According to an aspect the ranking is performed in the at least one remote entity 50 and the control unit 3. According to an aspect ranking comprises to give the probability a value. According to an aspect the value could be between two numbers, such as 1-10. According to an aspect the values could be high, medium and low.

An evaluation of the sequence of input data could identify a pattern in the input data that could be an indication of that an intrusion attempt is being made on the door operator system. The probability of that the sequence of input data corresponds to an intrusion attempt or not varies a lot depending on from which component the data is coming from and the type and rate of the input data. The evaluation is according to an aspect comparing the received sequence of input data with sequences of input data corresponding to intrusion attempts.

A sequence of input data could according to an aspect be that the activation sensors 6 and presence sensor 8 on the outside are activated intensively within a short period of time or that a door mounted sensors on revolving doors are activated. This could be a sequence of input data that corresponds to that a burglar is standing in front of the door operator system and is trying to force the door, however, the probability of that this only is a person standing in front of the door operator system 100 for any legit reason are rather high. The evaluation identifying such a sequence of input data would rank that the probability is low.

Another sequence of input data could be that the activation sensors, presence sensor on the outside are activated and the control unit 3 is indicating door leaf 5 movements via the encoder on the motor shaft. Further sequences of input data could be that sound analysis indicates abnormal activity on the door leafs 5 and surroundings, light sensor indicates abnormal light conditions around the door, it is identified that the lock is unlocked or the safety edge on the sectional doors are activated and deactivated sequentially. The probability of that these sequences of input data corresponds to natural causes are much lower, and these types of sequences of input data are more probable to correspond to an intrusion attempt. The ranking of such sequences of input data are thus higher.

By ranking the probability the measures taken could be in line with the ranking. If the ranking is low the measures could be to set an alarm that turns on a lamp in front of the door operator system 100. If the ranking is medium the measures could be to set an alarm that both turns on a lamp and plays a high an annoying sound on a loud speaker. If the ranking is high the measures could be to set an alarm that turns on a lamp, plays a high an annoying sound on a loud speaker and calls for a security firm.

If the ranking of the risk is above a pre-set risk, the door operator system 100 could be configured to trigger an alarm. According to an aspect an alarm could be one or more of a lamp and a speaker or to send an alarm signal to at least one remote entity 50 via the radio communication interface 30. According to an aspect the alarm comprise locking of other doors in a building, such like inner door in a vestibule if outer door is tampered. According to an aspect the alarm comprises increasing the closing force in the door to prevent the door from being bent open. According to an aspect the alarm comprises disabling of a reopening function due to obstruction, so the door tries to close even if someone is stuck between the door leafs 5. According to an aspect the alarm comprises putting the revolving door in a position in which the person that tries to break in is trapped in a closed compartment. According to an aspect the alarm comprises disabling safety sensors and other safety functions. According to an aspect the alarm comprises putting the door in manual mode to be more passive for the activity.

By evaluating and ranking the sequence of input data the door operator system 100 can identify if there is an intrusion attempt going on the door operator system 100 before a real intrusion has occurred. A triggered alarm during the intrusion attempt could in some cases scare the intruder and the attempt is interrupted. If an alarm is sent to a security firm before an intrusion has occurred the response time could be lowered and in many cases the intrusion could be stopped even before a real intrusion has occurred. According to an aspect the door operator is configured to determine if said sequence of input data corresponds to one or more of a number of predefined sequences of input data. By ranking the probability of if there is an intrusion attempt, the reliability increases if there is a sequence of input data clearly indicating a first "Suspect activity around the door", "Potential risk of intrusion" and finally "High risk of intrusion".

By ranking the probability the consequence of the action taken could be aligned with the level of reliability of analysis.

According to an aspect a lightening up of the entrance could be done in a first category of ranking, but calling for security could be done after very high reliability of analysis and a second category of ranking.

According to an aspect the input data and the sequence of input data could be logged for analysis purpose.

According to an aspect the control unit 3 comprises a central processing unit (CPU) and a data storage configured to store input data.

According to an aspect door operator 1 is a revolving door operator, a swing door operator, a hinged door operator, an up and over door operator, a roll door operator, a garage door operator, an industrial door operator, a high speed door operator, a sectional door operator, a gate operator, a barrier operator, an or any device having the same function as a door operator.

The input data is according to an aspect input data from one or more of the components detecting something or being moved.

The control unit 3 is according to an aspect configured to evaluate the sequence of input data by determining a pattern of the received sequence of input data.

According to an aspect, the pattern is a pattern found in the sequence of input data or associated with the sequence of input data. The pattern could be a pattern of sounds in a certain order and at a certain frequencies. The pattern could be a pattern from input data from one or more components. The pattern could be a pattern from input data from different one or more components. The pattern is a pattern that corresponds to one of a plurality of patterns of intrusion attempts of the door operator 1 and/or the door leaf 5 at least based on the received input data. By determining a pattern out of a plurality of pattern a ranking of the probability of that an intrusion attempt is occurring could be determined.

According to one aspect, the plurality of patterns is stored in the control unit 3.

The received input data is compared to the pattern to determine if the received sequence of input data corresponds to any of the plurality of patterns. If a pattern is determined out of the plurality of patterns as a known pattern the probability could be ranked. If no pattern is identified this could be an indication of that the probability is low.

Input data is according to an aspect a digital version of the things that the components has observed and could be data comprising information of sound waves, temperature, vibration, number of cycles, current, voltage, inertia, light, light waves, pictures, acceleration, friction and many other things, encoder etc. of the components and areas that the sensor are sensing.

According to an aspect a component is one of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor.

Figure 6:
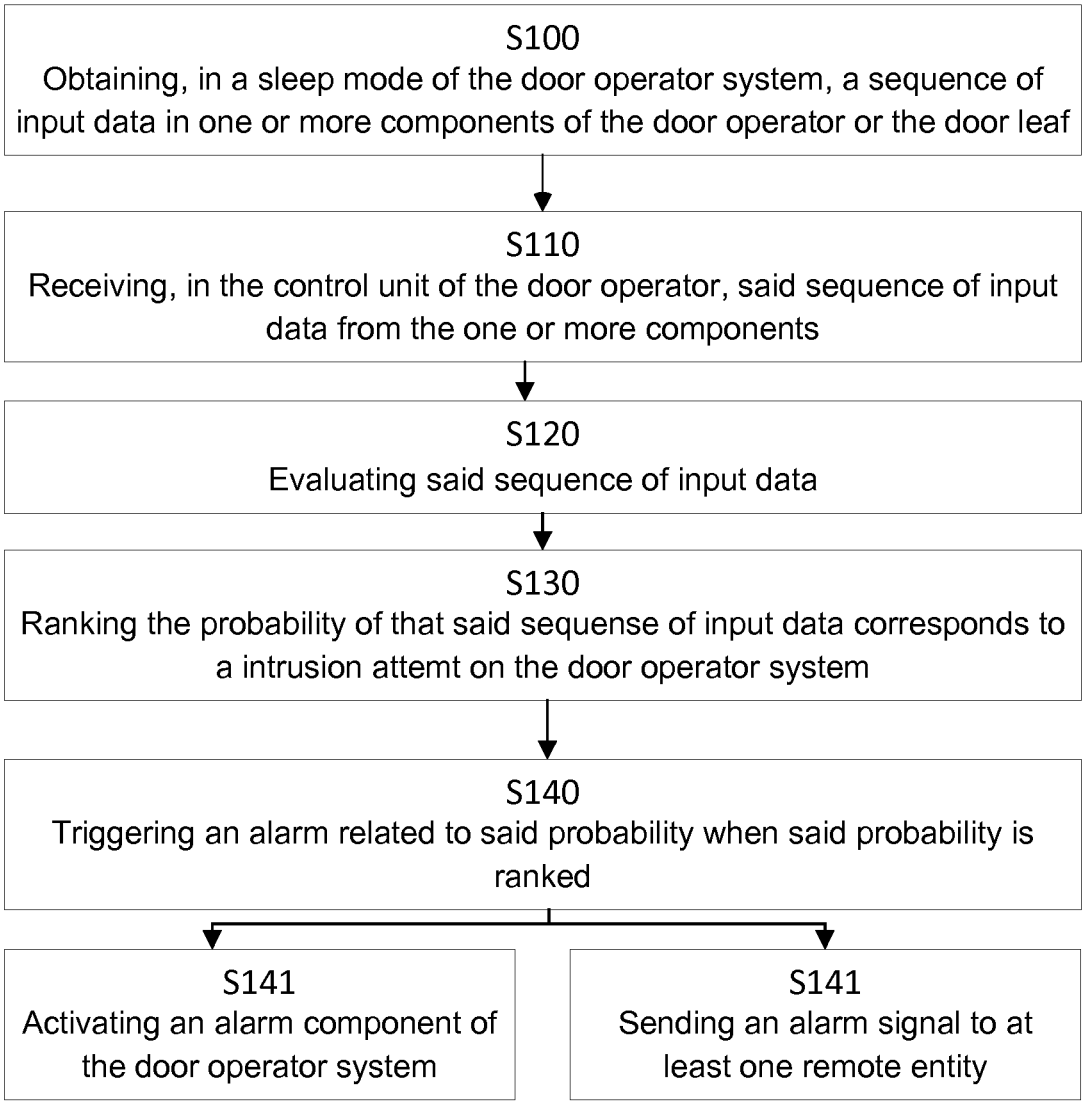
FIG. 6 discloses a method of a door operator system according to an aspect of the invention.

Hereafter, the method of the door operator system 100 in FIG. 1-5. in accordance to aspects of the invention will be described with reference to FIG. 6.

The method comprising: obtaining S100, in a sleep mode of the door operator system 100, a sequence of input data in one or more components of the door operator 1 or the door leaf 5, receiving S110, in the control unit 3 of the door operator 1, said sequence of input data from the one or more components, and evaluating S120 said sequence of input data and ranking S130 the probability of that said sequence of input data corresponds to an intrusion attempt on the door operator system.

According to an aspect the step of evaluating S120 is performed in said control unit 3.

According to an aspect the step of evaluating S120 is performed in the remote entity 50.

The ranking S130 of the probability is according to an aspect categorized into at least a low or a high probability category. According to an aspect the ranking S130 of the probability is categorized into at least three different probability categories.

According to an aspect the step ranking S130 is followed by the step of triggering S140 an alarm related to said probability when said probability is ranked.

According to an aspect the step of triggering S140 comprise the step of activating S141 an alarm component 20 of the door operator system 100.

The alarm component could be one or more of a lamp and a speaker. According to an aspect the alarm comprise locking of other doors in a building, such like inner door in a vestibule if outer door is tampered. According to an aspect the alarm comprises increasing the closing force in the door to prevent the door from being bent open. According to an aspect the alarm comprises disabling of a reopening function due to obstruction, so the door tries to close even if someone is stuck between the door leaves. According to an aspect the alarm comprises putting the revolving door in a position in which the person that tries to break in is trapped in a closed compartment. According to an aspect the alarm comprises disabling safety sensors and other safety functions. According to an aspect the alarm comprises putting the door in manual mode to be more passive for the activity.

According to an aspect the step of triggering S140 comprise the step of sending S142 an alarm signal to at least one remote entity 50.

The step of sending an alarm signal to at least one remote entity is according to an aspect made via a radio communication interface 30 of the door operator 1 configured to communicate with the at least one remote entity 50.

According to an aspect said components is one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf.

According to an aspect the step of ranking S130 the probability of that said sequence of input data comprise the step of determining if said sequence of input data corresponds to one or more of a number of predefined sequences of input data.

The person skilled in the art realizes that the present invention by no means is limited to the preferred embodiments described above. On the contrary, many modifications and variations are possible within the scope of the appended claims. For example, a sliding door set may comprise of more than two sliding door leafs, arranged in the same way as discussed above.

The description of the aspects of the disclosure provided herein has been presented for purposes of illustration. The description is not intended to be exhaustive or to limit aspects of the disclosure to the precise form disclosed, and modifications and variations are possible in light of the above teachings or may be acquired from practice of various alternatives to the provided aspects of the disclosure. The examples discussed herein were chosen and described in order to explain the principles and the nature of various aspects of the disclosure and its practical application to enable one skilled in the art to utilize the aspects of the disclosure in various manners and with various modifications as are suited to the particular use contemplated. The features of the aspects of the disclosure described herein may be combined in all possible combinations of methods, apparatus, modules, systems, and computer program products. It should be appreciated that the aspects of the disclosure presented herein may be practiced in any combination with each other.

It should be noted that the word "comprising" does not necessarily exclude the presence of other elements or steps than those listed. It should further be noted that any reference signs do not limit the scope of the claims.

The invention claimed is:

1. A method in a door operator system comprising a door operator connected to and arranged to move at least one door leaf between an open and closed position, the door operator comprising a control unit configured to control the movement of the at least one door leaf, the method comprising:

obtaining, in a sleep mode of the door operator system and while the at least one door leaf is in the closed position, a sequence of input data in one or more components of the door operator or the at least one door leaf, wherein, in the sleep mode, the door operator is prevented from moving the at least one door leaf to the open position;

receiving, in the control unit of the door operator, said sequence of input data from the one or more components while in the sleep mode;

evaluating, in the sleep mode, said sequence of input data; and ranking, while in the sleep mode, a probability that said sequence of input data corresponds to an intrusion attempt on the door operator system.

2. The method according to claim 1, wherein the step of evaluating is performed in said control unit.

3. The method according to claim 1, wherein the step of evaluating is performed in a remote entity.

4. The method according to claim 1, wherein the ranking of the probability is categorized into at least a low or a high probability category.

5. The method according to claim 1, wherein the ranking of the probability is categorized into at least three different probability categories.

6. The method according to claim 1, further comprising the step of triggering an alarm related to said probability when said probability is ranked.

7. The method according to claim 6, wherein the step of triggering comprises the step of activating an alarm component of the door operator system.

8. The method according to claim 7, wherein the alarm component is one or more of a lamp and a speaker.

9. The method according to claim 6, wherein the step of triggering comprises the step of sending an alarm signal to at least one remote entity.

10. The method according to claim 9, wherein the step of sending an alarm signal to at least one remote entity is made via a radio communication interface of the door operator configured to communicate with the at least one remote entity.

11. The method according to claim 1, wherein said one or more components is one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator or the said at least one door leaf.

12. The method according to claim 1, wherein the step of ranking the probability of that said sequence of input data comprises the step of determining if said sequence of input data corresponds to one or more of a number of predefined sequences of input data.

13. A door operator comprising:

a control unit and a drive unit connected to the control unit, wherein;

the drive unit is arranged to be connected to and move at least one door leaf between an open and closed position;

the control unit is arranged to control the drive unit;

the door operator is configured to be arranged in a sleep mode and in an activated mode, wherein, in the sleep mode, the at least one door leaf is in the closed position and the drive unit is prevented from moving the at least one door leaf to the open position, and the door operator is, in the sleep mode of the door operator, configured to:

receive, in the control unit, a sequence of input data from one or more components of the door operator or the at least one door leaf, wherein said sequence of input data includes at least an external force applied to the at least one door leaf;

evaluate said sequence of input data; and rank a probability that said sequence of input data corresponds to an intrusion attempt on the door operator.

14. The door operator according to claim 13, wherein the control unit is configured to evaluate said sequence of input data.

15. The door operator according to claim 13, further comprising a radio communication interface configured to communicate with at least one remote entity and to send said sequence of input data to said at least one remote entity.

16. The door operator according to claim 13, further configured to rank the probability into at least a low or a high probability category.

17. The door operator according to claim 13, further configured to rank the probability into at least three different probability categories.

18. The door operator according to claim 13, further configured to trigger an alarm related to a probability when said probability is ranked.

19. The door operator according to claim 18, further comprising an alarm component configured to activate an alarm.

20. The door operator according to claim 19, wherein the alarm component is one or more of a lamp and a speaker.

21. The door operator according to claim 18, configured to send an alarm signal to at least one remote entity via a radio communication interface.

22. The door operator according to claim 13, wherein said components is one or more of a sound sensor, a movement sensor, voltage sensor, current sensor, resistance sensor, temperature sensor, a light sensor, a pressure sensor, a humidity sensor, a time sensor, a global positioning system (GPS), infrared sensor, a camera, a ccd-camera, a time of flight sensor and/or ultrasonic sensor, a battery, the control unit, a drive unit, a belt transmission, a carriage wheel, an arm system and a floor guide, sealing's, springs, gear box, guide rails, brakes, shaft, bearings, activation sensors, safety sensors, combined sensors, sensors, light grids, mechanical sensors of the door operator and/or the said at least one door leaf.

23. The door operator according to claim 13, further configured to determine if said sequence of input data corresponds to one or more of a number of predefined sequences of input data.

24. The door operator according to claim 13, wherein the control unit comprise a central processing unit (CPU) and a data storage configured to store said sequences of input data.

25. The door operator according to claim 13, wherein the door operator is a revolving door operator, a swing door operator, a hinged door operator, an up and over door operator, a roll door operator, a garage door operator, an industrial door operator, a high speed door operator, a sectional door operator, a gate operator, a barrier operator, an or any device having the same function as a door operator.

* * * * *